United States Patent [19]

Holmes

[11] Patent Number: 4,595,126

[45] Date of Patent: Jun. 17, 1986

[54] PORTABLE WATER CONTAINER WITH EASILY-REPLACEABLE LINER

[76] Inventor: William A. Holmes, 209 Highland Ave., Piedmont, Calif. 94611

[21] Appl. No.: 410,420

[22] Filed: Aug. 23, 1982

[51] Int. Cl.[4] ..... B65D 37/00; A45F 3/20; F16L 5/00

[52] U.S. Cl. ..... 222/105; 222/175; 222/180; 222/567; 24/459; 126/426; 138/30; 138/44; 285/200; 383/80; 383/109

[58] Field of Search ..... 222/92, 94, 105, 106, 222/107, 175, 173, 180, 566–568, 570, 386.5, 129, 131, 130, 183; 24/263 R, 263 A, 136 B, 30.5 L, 459; 383/80, 96, 109, 113; 224/148; 138/30, 44; 285/161, 200, 206, 208; 126/426

[56] References Cited

U.S. PATENT DOCUMENTS

| | | | |
|---|---|---|---|
| 1,602,305 | 10/1926 | Helm . | |
| 1,619,120 | 3/1927 | Heaton | 222/175 |
| 1,858,787 | 5/1932 | Ottenheimer | 24/72.5 |
| 2,793,793 | 5/1957 | Sampson | 222/386.5 X |
| 3,045,310 | 7/1962 | Velinsky | 24/263 R |
| 3,092,848 | 6/1963 | Gronvold . | |
| 3,128,913 | 4/1964 | Specketer | 222/566 X |
| 3,178,063 | 4/1965 | Cox, Jr. | 222/105 |
| 3,204,825 | 9/1965 | Underwood | 222/105 |
| 3,936,912 | 2/1976 | Flanagan, Jr. | 24/73 |
| 4,111,186 | 9/1978 | Ross et al. | 126/426 |
| 4,165,023 | 8/1979 | Schmit | 222/183 X |
| 4,193,518 | 3/1980 | Holmes | 222/180 X |
| 4,222,422 | 9/1980 | Lofberg | 383/109 X |

FOREIGN PATENT DOCUMENTS

| | | | |
|---|---|---|---|
| 2147675 | 3/1973 | Fed. Rep. of Germany | 285/200 |

*Primary Examiner*—Joseph J. Rolla
*Assistant Examiner*—Kevin P. Shaver
*Attorney, Agent, or Firm*—Glen R. Gruenwald; David Pressman

[57] ABSTRACT

A portable water container is disclosed having an inner bag formed of a flexible water impermeable sheet and an outer protective covering for the bag formed of a wear-resistant fabric; a tubular drain and fill conduit mounted in aligned openings in the bag and covering; and a releasable seal clamping the sheet forming the inner bag in a watertight sealed connection for sealing the conduit to and in flow communication with such bag; and a clamp securing the conduit in a load-bearing attachment to the covering.

19 Claims, 4 Drawing Figures

PORTABLE WATER CONTAINER WITH EASILY-REPLACEABLE LINER

BACKGROUND OF THE INVENTION

The invention relates to portable water bags used typically for personal water requirement by campers, backpackers, travelers and the like; see for example my earlier U.S. Pat. No. 4,193,518.

The need and utility of a portable water container of the present character is discussed in my aforementioned patent. The unit of the present invention represents an improvement and simplification in certain structure of the container which overcome problems heretofore encountered in the sealing and replacement of the several components of the unit. In addition to U.S. Pat. No. 4,193,518, Applicant is familiar with the following U.S. Pat. Nos. 1,602,305; 1,619,120; 1,858,787; 3,045,310; 3,092,848; 3,204,825 and 3,936,912.

SUMMARY OF THE INVENTION

An object of the present invention is to provide a lightweight, readily portable, water container combining the advantages of a replaceable inner bag formed of an inexpensive thin gauge water impermeable plastic sheet and an outer protective covering formed of wear-resistant fabric and having a tubular drain and fill conduit releasably secured to and in sealed flow communication with the inner bag and being likewise releasably secured to the covering to provide a load-bearing attachment of the conduit and covering, the aforementioned releasable securements affording easy and rapid replacement of either or both of the inner bag and covering.

Another object of the present invention is to provide a portable water container of the character above in which the enclosures of the containers may be of simple, inexpensive, rectangular form and in which the assembly structure affords mass, low-cost production of the unit.

A further object of the present invention is to provide a portable water container of the character described which is structured to afford a selective positioning of the container for solar heating of the contents.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims and their legal equivalents.

DETAILED DESCRIPTION OF THE INVENTION

Figure 1:
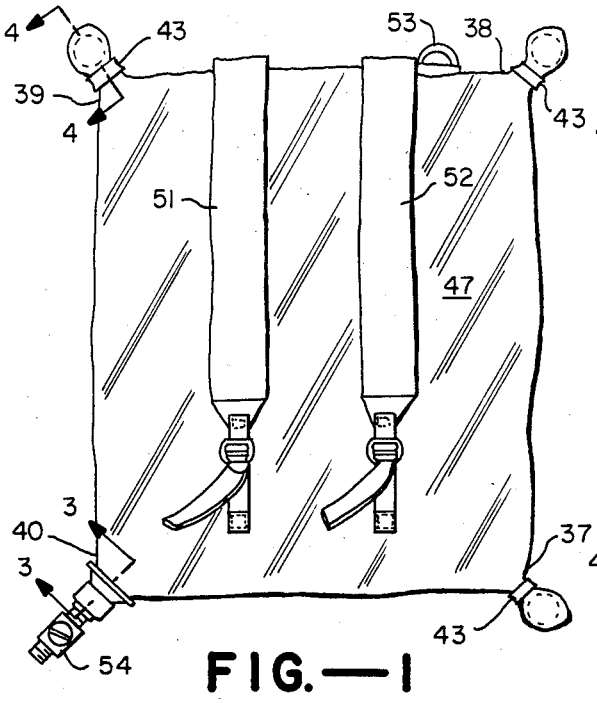
FIG. 1 is a side elevation of a portable water container constructed in accordance with the present invention.

With reference to the accompanying drawings, the portable water container of the present invention comprises briefly an inner bag 7 formed of a flexible, water impermeable sheet having an opening 8 in a wall portion 9 thereof; an outer protective covering 11 for the bag and being formed of a wear resistant fabric, such as nylon, and mounted in surrounding relation to bag 7 and having an opening 12 in a wall portion 13 registering with opening 8; a tubular drain and fill conduit 16 mounted in opening 8; means 17 releasably clamping wall portion 9 in a water-tight sealed connection to conduit 16, sealing the conduit to and in flow communication with bag 7; and means 18 securing wall portion 13 to the conduit and providing a load-bearing attachment of the conduit and covering 11.

Figure 3:
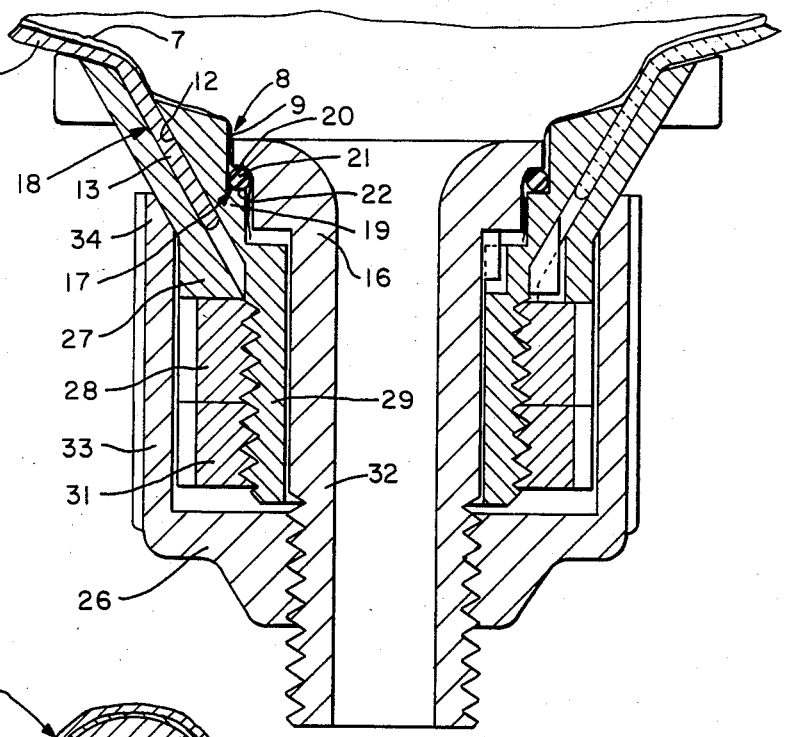
FIG. 3 is a fragmentary cross-sectional view on a somewhat enlarged scale and taken substantially on the plane of line 3—3 of FIG. 1.

As will be best seen from FIG. 3, means 17 comprises an annular shoulder 20 which is formed on conduit 16 and is mounted interiorly of wall portion 9; and an annular member 19 mounted exteriorly of wall portion 9 and dimensioned for movement to and from shoulder 20 to clamp wall portion 9 therebetween. Preferably an O-ring type gasket 21 is mounted between shoulder 20 and the annular member 19 to ensure a good seal. As here shown, member 19 is provided with a shoulder 22 juxtaposed to shoulder 20 for clamping the gasket 21 and wall portion 9 therebetween, gasket 21 being preferably mounted on shoulder 22 for compression between the shoulder and the plastic sheet forming the inner bag. Annular member 19 is mounted for longitudinal reciprocation on conduit 16 and a nut member 26 is threaded on the conduit and bears on member 19 for displacement thereof to clamping position.

Means 18 involves a disposition of annular member 19 at the interior side of the covering wall portion 13; a second annular member 27 surrounding annular member 19 and positioned in engagement with the exterior side of wall portion 13; and a nut 28 threaded on a generally cylindrical part 29 of annular member 19 and bearing on an end of member 27 for displacement thereof to a position clamping wall portion 13 between the two annular members 19 and 27. A second lock nut 31 which is a lock nut is also threaded on part 29 to retain the two annular members 19 and 27 in a locked assembly telescopically mounted on a cylindrical part 32 of conduit 16. Nut member 26 is formed with a cylindrical collar 33 which surrounds nuts 28 and 31 and has one end 34 disposed to bear upon the exterior of annular member 27 to displace the locked assembly against shoulder 20 for sealing the conduit and inner bag 7. As will be best observed from FIG. 3, the annular members 19 and 27 are formed of inter-fitting conical shapes converging exteriorly of the covering to provide a wedged gripping of wall portion 13 therebetween. The clamping of wall portion 13 between the conical-shaped members 19 and 27 affords a secure load-bearing attachment of the conduit and covering. Preferably conduit 16 and the two annular members are formed with longitudinally inter-fitting grooves and ribs which key the parts against relative rotary displacement during assembly of the parts to ensure proper face-to-face engagement of the parts and portions being clamped together.

Figure 2:
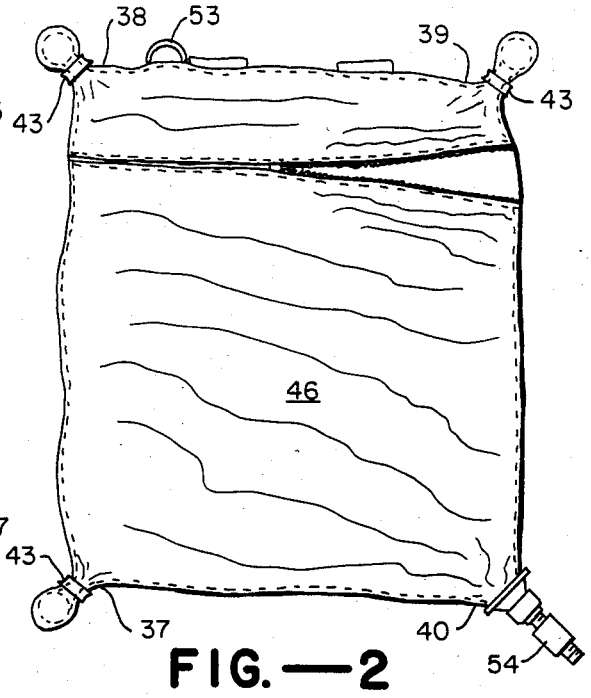
FIG. 2 is a side elevation of the reverse side of the container.
Figure 4:
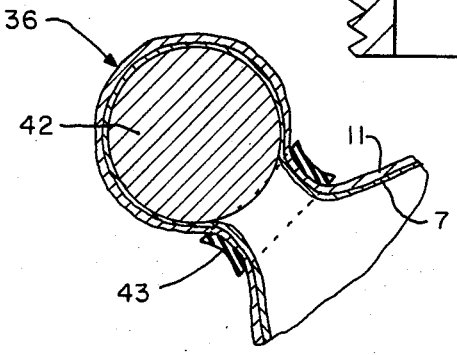
FIG. 4 is a fragmentary cross-sectional view on an enlarged scale of a portion of the container taken substantially on the plane of line 4—4 of FIG. 1.

Since the present device combines the advantages of a replaceable inner bag formed of an inexpensive thin gauge water impermeable plastic sheet and an outer protective covering of wear resistant fabric and, it is important that these two membranes be secured together at spaced peripheral portions of the bag and covering, and at the same time it is important that the attaching means be readily releasable so as to afford an easy and rapid replacement of either or both the inner bag and covering. Means 36 for providing such an attachment is illustrated in FIG. 4. Preferably also the bag and covering are of polygonal shape as seen in FIGS. 1 and 2 so as to provide a plurality of peripherally spaced corners 37, 38, 39 and 40; and the openings 8 and 12 and their adjacent wall portions 9 and 13 are located at one of the corners 40 together with the conduit 16 and attaching means, and the bag to covering attaching means 36 is located at the other corners 37, 38 and 39. The bag end covering may be simply formed as rectangles with opposed rectangular sides connected together at their peripheries. The sheets forming the inner bag will of course be heat sealed or otherwise secured against water leakage. The registering openings in the bag and the covering may be simply formed by cutting diagonally across one of the corners, such as corner 40, thus providing wall portions 9 and 13 contiguous to openings 8 and 12 and the disposition of these parts together with the drain and fill conduit 16 at a corner 40 of the container. Since this corner is diagonally opposite ring 53, conduit 16 will depend from the container when the latter is hung by ring 53.

As here shown, means 36 may simply comprise a plurality of parts 42, preferably spherically shaped, mounted one each interiorly of bag 7 at its corners 37–39; and a member 43 girdling covering 11 adjacent part 42 and capturing the parts in the corners. Members 43 may comprise any suitable ring-type clamp, e.g., a strap with a Velcro® hook and eylet end attachment or elastic ring members will serve satisfactorily for this purpose. While the container is preferably formed with a rectangular shape as illustrated, it may be of rounded form with attaching parts 42 and 43 positioned at one or a plurality of peripheral locations.

As another feature of the present invention, exterior covering 11 is formed to provide a side 47, see FIG. 1, formed of light-transmitting material capable of passing solar energy to the interior of bag 7, and an opposite side 46, see FIG. 2, formed of a dark opaque material for absorbing the solar energy transmitted for conduction to the contents. The solar-transmitting section may be formed of a sheet of translucent material, which is sewn to and forms part of the outer covering. Access to the interior of the outer protective cover may be obtained via a zipper style connection to facilitate replacement of the inner bag.

A pair of shoulder straps 51 and 52 are preferably sewn or otherwise secured to the outer covering to facilitate backpacking of the container. Also a supporting ring 53 is preferably secured adjacent corner 38 opposite to the drain conduit to properly position the conduit for discharge of the contents when the container is hung on ring 53. A valve 54 is shown on the discharge end of conduit 16 in FIGS. 1 and 2.

What is claimed is:

1. A portable water container comprising:

an inner bag formed of a flexible water-impermeable sheet having an opening in a first wall portion thereof;

an outer protective covering for said bag formed of a wear-resistant fabric and mounted in surrounding relation to said inner bag and having an opening in a second wall portion thereof which registers with said first-named opening;

a tubular drain and fill conduit mounted in said first-named opening; said tubular conduit comprising an annular shoulder mounted interiorly of said first wall portion;

clamp means releasably clamping said first wall portion in a watertight sealed connection to said conduit for sealing said conduit to and in flow communication with said bag; and securement means securing said second wall portion to said conduit and providing a load-bearing attachment of said conduit to said covering, said securement means comprising:

a first annular member being mounted in engagement with the interior side of said second wall portion, a second annular member surrounding said first annular member and being mounted in engagement with the exterior side of said second wall portion, and a nut threaded onto said first annular member and bearing on said second annular member for displacement thereof so as to clamp said second wall portion between said first and second annular members.

2. The device of claim 1, areas of said first and second annular member engaged with said second wall portion being of interfitting conical form converging exteriorly of said covering and providing a wedged gripping of said second wall portion.

3. The device of claim 1, said covering being formed to provide a side formed of light transmitting material capable of passing solar energy to said bag, and an opposite side formed of a material absorbing the transmitted solar energy.

4. The device of claim 1, said nut and first and second annular members providing a locked assembly telescopically mounted on said conduit; and a nut member threaded on said conduit and bearing on said locked assembly for displacement of said first annular member.

5. The device of claim 4, and means preventing relative rotative displacement of said conduit and said first and second annular members.

6. The device of claim 4, and a sealing gasket mounted between said shoulder and first wall portion and said first annular member.

7. The device of claim 6, said nut member surrounding said nut when threaded on said conduit and engaging said second annular member to urge said second annular member, first wall portion, gasket and shoulder in compressive sealed engagement.

8. The device of claim 1, said bag and covering being of polygonal form providing a plurality of peripherally-spaced corners, and means demountably securing together peripheral portions of said bag and covering; and said first and second wall portions being located at one of said corners, and said last-named means being located at another of said corners.

9. The device of claim 8, said last-named means comprising:

parts mounted one each interiorly of said bag at each of said other corners; and members girdling said covering adjacent said other corners and capturing said parts in said other corners.

10. The device of claim 9, said parts being spherically shaped.

11. A two-part holder with an easily-replaceable liner comprising:

a liner formed of a flexible, water-impermeable sheet having an opening therein surrounded by a first wall portion thereof, a protective covering for said liner, said covering formed of a wear-resistant fabric and mounted adjacent to said linear and having an opening therein which registers with said opening of said liner, said opening being surrounded by a second wall portion thereof, a tubular drain conduit, one end of said conduit having a flange portion which is positioned on the side of said liner remote from said protective covering, in contact with said remote side of said first wall portion of said liner, said conduit protruding from said liner and having tightening member engagement means on its outer surface adjacent the other end thereof, said protective covering having rigid tubular clamp means attached to said second wall portion thereof to provide an extension of said opening in said covering, said conduit extending through said tubular clamp means and being keyed thereto for preventing rotation of said conduit with respect to said tubular clamp means, and tightening member means engaged to said tightening member engagement means on said conduit for squeezing said tubular clamp means against said flange portion so as to clamp said first wall portion of said liner between said flange portion and said tubular clamp means, whereby said liner can be easily replaced by position the flange of said conduit on said remote side of said opening of said liner bag and clamping said first wall portion of said liner to said flange through use of said tightening member means.

12. A portable water container with an easily-replaceable inner liner comprising:

an inner bag formed of a flexible, water-impermeable sheet having an opening therein surrounded by a first wall portion thereof, an outer protective covering for said inner bag formed of a wear-resistant fabric and mounted in a surrounding relationship to said inner bag and having an opening therein which registers with said opening of said inner bag, said opening surrounded by a second wall portion thereof, a tubular drain and full conduit, one end of said conduit having a flange portion which is positioned inside of said inner bag, in contact with the inner surface of said first wall portion of said inner bag, said conduit protruding from said inner bag and having tightening member engagement means on its outer surface adjacent the other end thereof, said outer protective covering having rigid tubular clamp means attached to said second wall portion thereof to provide an extension of said opening in said covering, said conduit extending through said tubular clamp means and being keyed thereto for preventing rotation of said conduit with respect to said tubular clamp means, and tightening member means engaged to said tighening member engagement means on said conduit for squeezing said tubular clamp means against said flange portion so as to clamp said first wall portion of said inner bag between said flange portion and said tubular clamp means, whereby said inner bag can be easily replaced by positioning the flange of said conduit within said opening of said inner bag and clamping said first wall portion of said inner bag to said flange through use of said tighening member means.

13. The container of claim 12 wherein said tightening member engagement means on said outer surface of said conduit comprises screw threads and said tightening member means comprises a threaded nut.

14. The container of claim 12 further including an O-ring seal around said conduit adjacent the flange thereof, a portion of said inner bag being clamped between said O-ring seal and said conduit.

15. The container of claim 12 wherein said clamp means has flange thereon adjacent the outer side of said first wall portion of said inner bag so as to clamp said first wall portion between the flanges of said clamp means and said conduit.

16. The device of claim 12 wherein one side of said covering is formed of light-transmitting material capable of passing solar energy to said bag, the opposite side of said bag formed of a material for absorbing the passed solar energy.

17. The device of claim 12, said bag and covering being of polygonal form for providing a plurality of peripherally-spaced corners, said first and second wall portions being located at one of said corners.

18. The device of claim 17 further including a plurality of parts respectively mounted in each of the other corners of said bag and covering, and a plurality of respective members girdling said covering at said other corners and capturing said parts in said other corners.

19. The device of claim 18 wherein said parts are spherically shaped.

* * * * *